US007394009B2

(12) United States Patent
Judd

(10) Patent No.: US 7,394,009 B2
(45) Date of Patent: Jul. 1, 2008

(54) DRUM CYMBAL WASHER

(75) Inventor: Brian Thomas Judd, Campbell, CA (US)

(73) Assignee: Probe Specialists, Inc., Morgan Hill, CA (US)

( * ) Notice: Subject to any disclaimer, the term of this patent is extended or adjusted under 35 U.S.C. 154(b) by 229 days.

(21) Appl. No.: 11/332,932

(22) Filed: Jan. 17, 2006

(65) Prior Publication Data

US 2006/0156902 A1 Jul. 20, 2006

Related U.S. Application Data

(60) Provisional application No. 60/644,970, filed on Jan. 18, 2005.

(51) Int. Cl.
*G10D 13/02* (2006.01)

(52) U.S. Cl. ..... 84/421; 84/411 R; 84/416; 267/136; 267/140; 267/141.2; 267/141.4; 267/141.7; 248/634; 248/635

(58) Field of Classification Search ..... 267/150; 248/634, 635
See application file for complete search history.

(56) References Cited

U.S. PATENT DOCUMENTS 1,573,961 A * 2/1926 Zucker ..... 15/230.1
1,607,769 A * 11/1926 Meyer ..... 248/635
2,588,372 A * 3/1952 Erb ..... 411/432
2,670,229 A * 2/1954 Gore ..... 403/38
3,350,042 A * 10/1967 Stewart et al. ..... 267/141.4
3,831,923 A * 8/1974 Meldrum ..... 267/141
3,994,198 A * 11/1976 Herman ..... 84/421
4,216,695 A * 8/1980 Hoshino ..... 84/421
4,319,514 A * 3/1982 Donohoe ..... 84/421
4,526,083 A * 7/1985 LeMert ..... 84/421
4,799,845 A * 1/1989 Hrysko ..... 411/542
4,960,028 A * 10/1990 Ramirez ..... 84/421
5,367,939 A * 11/1994 Barker ..... 84/402
5,388,495 A * 2/1995 Atsumi ..... 84/422.3
5,419,524 A * 5/1995 Evans et al. ..... 248/346.4
5,544,871 A * 8/1996 Reinemuth et al. ..... 267/293
5,746,411 A * 5/1998 Bruas et al. ..... 248/635
5,751,551 A * 5/1998 Hileman et al. ..... 361/753
5,762,324 A * 6/1998 Wilbourn ..... 267/293
5,865,429 A * 2/1999 Gautheron ..... 267/141.7
5,897,075 A * 4/1999 Elder et al. ..... 242/608.2

(Continued)

OTHER PUBLICATIONS

All Elastomer Isolaters—Ring & Bushing Mount Series, db Engineering, http://www.novibration.com/content/view/48/75, viewed Oct. 24, 2007.*

(Continued)

*Primary Examiner*—Lincoln Donovan
*Assistant Examiner*—Robert W Horn
(74) *Attorney, Agent, or Firm*—Michael A. Glenn; Glenn Patent Group

(57) ABSTRACT

A resilient washer design having an annulus body and a concentric sleeve extending from the annulus with a plurality of ribs extending from the sleeve. The washer may have an opposing sleeve extending from the opposite side of the annulus with a second plurality of ribs in staggered location to the first set of ribs. This staggered position allows the annulus to flex between the ribs on opposing sides and resist compression of the washer when pressure is applied axially.

15 Claims, 3 Drawing Sheets

U.S. PATENT DOCUMENTS

| | | | | |
|---|---|---|---|---|
| 5,918,300 | A * | 6/1999 | Hsieh | 84/422.3 |
| 6,065,716 | A * | 5/2000 | Munster | 242/597.6 |
| 6,105,944 | A * | 8/2000 | David | 267/141.7 |
| 6,239,343 | B1 * | 5/2001 | Hoshino | 84/422.3 |
| 6,267,363 | B1 * | 7/2001 | Genequand et al. | 267/161 |
| 6,435,489 | B1 * | 8/2002 | Rice et al. | 267/140.5 |
| 6,471,179 | B1 * | 10/2002 | Tousi et al. | 248/635 |
| 6,540,190 | B2 * | 4/2003 | Keshavjee | 248/346.11 |
| 6,940,006 | B2 * | 9/2005 | Takegawa | 84/327 |
| 7,069,805 | B2 * | 7/2006 | Ishizuka et al. | 74/457 |
| 7,102,066 | B2 * | 9/2006 | Chang | 84/422.1 |
| 7,144,315 | B1 * | 12/2006 | Sun et al. | 451/541 |
| 7,199,297 | B2 * | 4/2007 | Anderson | 84/422.3 |
| 7,222,818 | B2 * | 5/2007 | Couchey et al. | 242/614 |
| 7,222,823 | B2 * | 5/2007 | Thomas et al. | 244/173.2 |
| D544,890 | S * | 6/2007 | Sun et al. | D15/126 |
| 2004/0113339 | A1 * | 6/2004 | Masterson et al. | 267/153 |
| 2005/0067548 | A1 * | 3/2005 | Inoue | 248/635 |
| 2005/0206058 | A1 * | 9/2005 | Masterson et al. | 267/293 |
| 2006/0156902 | A1 * | 7/2006 | Judd | 84/422.1 |
| 2007/0120301 | A1 * | 5/2007 | Domen et al. | 267/152 |

OTHER PUBLICATIONS

Cymbal Washer Kit, drumbum, http://store.drumbum.com/skuA-74.html, viewed Sep. 12.*

Wedgie Premium Cymbal Washer Kit, The Music Motel, http://www.themusicmotel.com/store/product.asp?pid=2662&catid=1375&vid=0, viewed Sep. 12, 2007.*

Lock Washers, ITW Shakeproof, http://www.thread-rite.com/shel/tr_livelock.htm, viewed Oct. 24, 2007.*

Wedgie Premium Cymbal Kit, Wedgie Products, http://www.wedgie.com/cgi-bin/ccp5/cp-app.cgi?usr=50X4746954&rnd=7474343&rrc=N&cip=151.207.244.4&pg=ste_detail_cymbal, viewed Sep. 24, 2007.*

* cited by examiner

DRUM CYMBAL WASHER

CROSS-REFERENCE TO RELATED APPLICATIONS

The present Utility patent application claims priority to the provisional application for patent having the application number of 60/644,970 and was filed on Jan. 18, 2005.

FIELD OF THE INVENTION

The present invention relates to a novel cymbal washer design that replaces the traditional felt washer providing more stability and control while providing less dampening of the sound.

BACKGROUND OF THE INVENTION

Conventionally a metal washer is fitted over the threaded end of the shaft resting on the upper shoulder of the unthreaded portion of the shaft and then a cylindrical plastic sleeve is fitted over the lower end of the threaded portion of the shaft. A felt washer is then slipped over the plastic sleeve, followed by the cymbal which has a circular hole in its center. A second felt washer is then usually placed over the cymbal and a wing nut screwed down upon the upper felt washer to hold the cymbal onto the cymbal stand. Usually the shaft is positioned vertically, but may be tilted or even horizontal.

The purpose of the felt washers is first to protect and cushion the cymbal as it moves on the shaft of the holder preventing damaging contact with the support stand or retaining wing nut. Additionally the felt acoustically insulates the cymbal from the mounting hardware. Felt varies in flexibility depending on the size of the spaces between the fibers and layers of the felt washer. The weight of the cymbal will over time crush the felt material thus limiting the movement and function of the felt washer. The flexibility of the felt governs the cymbal movement, when struck, and the sound of the cymbal This conventional means of mounting the cymbal on the cymbal stand has proven generally unsatisfactory. While providing some protection of the cymbal, the felt washers tend to dampen the vibration of the cymbal, and provide unsatisfactory sound from the cymbal.

BRIEF DESCRIPTION OF THE DRAWINGS

The present invention is illustrated by way of example, and not by way of limitation, in the figures of the accompanying drawings and in which like reference numerals refer to similar elements and in which.

Unless otherwise indicated illustrations in the figures are not necessarily drawn to scale.

SUMMARY OF THE INVENTION

The present invention, generally speaking, provides for a resilient washer structure including an annulus having a top side and a bottom side; a concentric sleeve extending from the annulus; and multiple ribs extending from the sleeve on one side of the annulus and defining an upper surface of the resilient washer structure. Similar features may be formed on an opposite side of the annulus, with the ribs on opposite sides being formed in staggered alignment relative to one another. This positioning of the ribs allows the washer to compress by flexing the annulus in the space between the ribs when force is applied to the top surfaces of the ribs. A rim may be provided adjoining the terminal ends of the ribs further adding rigidity and compression resistance to the washer.

One or both of the upper surface and the lower surface may be concave.

In other aspects of the invention, a cymbal washer is provided having a resilient body with a center hole and one or more touch areas for contacting the cymbal surrounding the center hole, the touch areas being raised above surrounding areas of the resilient body. One or more voids may adjoin the touch areas, whereby muting of a sound produced by the cymbal may be reduced. Similar features may be formed on an opposite side of a plane of symmetry, with the touch areas and the voids on opposite sides being formed in staggered alignment relative to one another.

DETAILED DESCRIPTION OF THE PREFERRED EMBODIMENTS

The present invention is best understood by reference to the detailed figures and description set forth herein.

Figure 1:
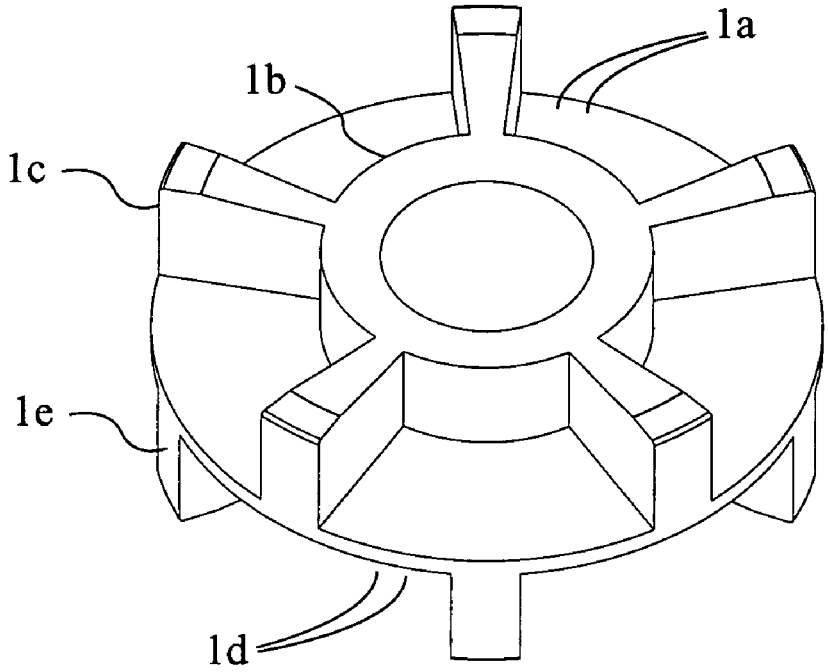
FIG. 1 illustrates an angled perspective view of a first embodiment of the cymbal washer.

A washer for use in the mounting of cymbals that consists of a flat washer body FIG. 1*a* with sleeve 1*b* extending from the center of the washer and a plurality of ribs 1*c* that are raised perpendicularly from the washer surface 1*a* and extend from the sleeve 1*b* outward to the end of the washer. On the other side of the washer 1*d* the same amount of ribs 1*e* are equally formed and positioned to be centrally offset from the first set of ribs.

In its preferred embodiment this washer is molded out of a thermoplastic elastomer or TPE (i.e. plastic moldable rubber like Santoprene). Also the movement control and sound dampening can be varied with the use of different durometers of elastomer materials.

Figure 6:
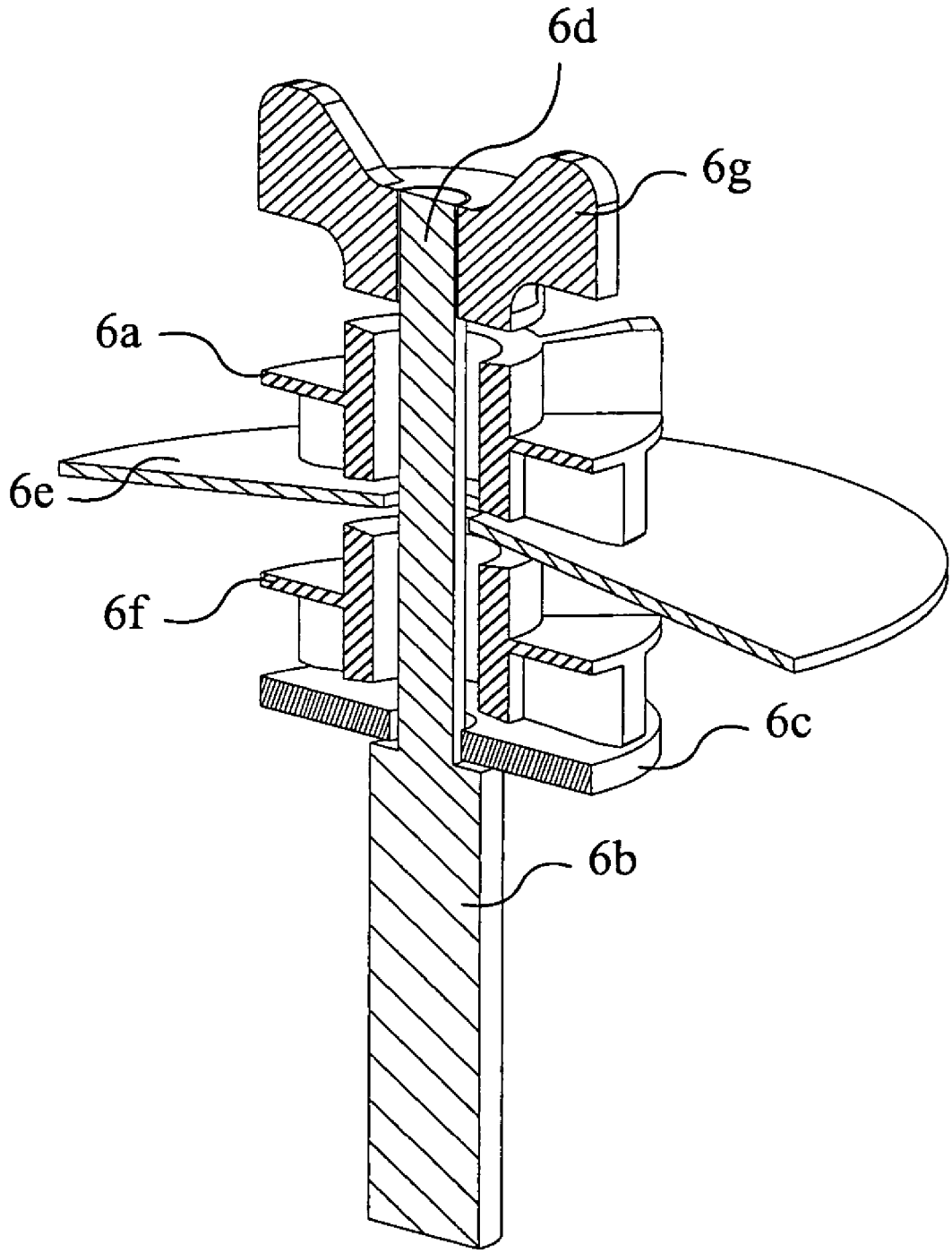
FIG. 6 illustrates a side perspective, cutaway view showing the positioning of the cymbal washers relative to the cymbal and cymbal stand hardware.

This washer is installed on a cymbal stand FIG. 6*b* just like traditional felt based washers. The stand will usually have a platform or washer 6*c* at the base of the threaded rod 6*d* to support the bottom washer 6*f*. The cymbal 6*e* is then placed over the first washer 6*f* followed by another washer 6*a* to be placed on top of the cymbal. A wing nut 6*g* or other clamping device is then placed on the shaft 6*d* above the washers to keep the assembly in place.

Figure 2:
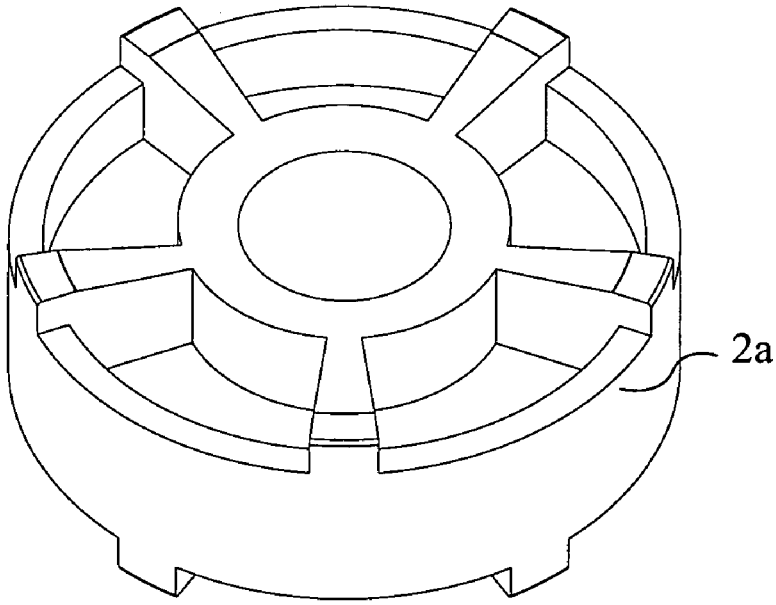
FIG. 2 illustrates a side perspective view of an instance of the first embodiment shown with the described concave rib feature.
Figure 3:
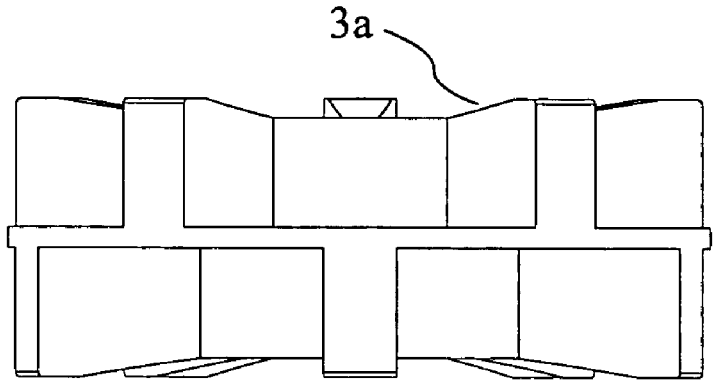
FIG. 3 illustrates a side perspective view of an instance of the first embodiment shown without the described concave rib feature.
Figure 4:
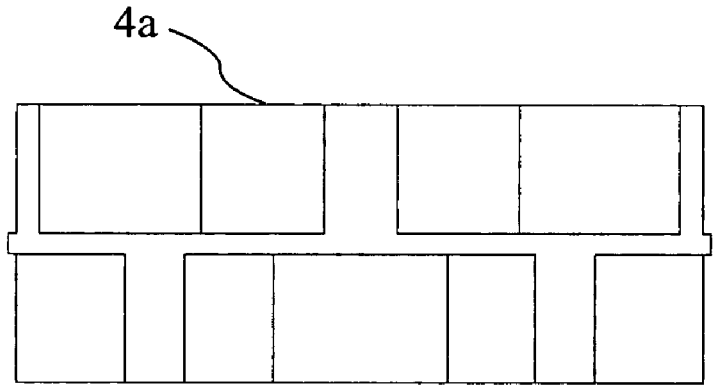
FIG. 4 illustrates an angled perspective view of a second embodiment of the cymbal washer showing an outer ring connecting the ribs.
Figure 5:
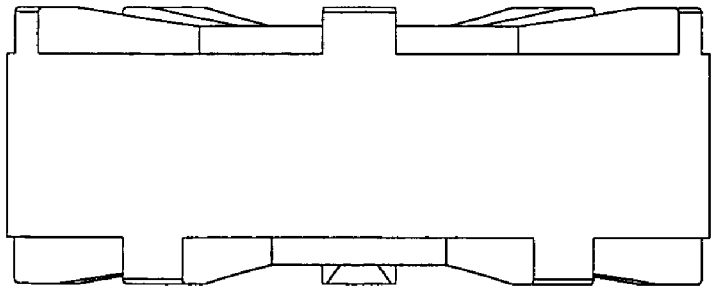
FIG. 5 illustrates a side perspective view of an instance of the second embodiment.

The washer has a number of ribs on each side of the washer FIGS. 1*c* and 1*e* which are off-set from one side to the other to help the washer flex and respond while still supporting the weight of the cymbal in play. The offset ribs give the washer a spring like feature to allow and then counter the compression of the ribs when axially compressed. Additionally a rim band of material FIG. 2*a* connecting the outer ends of the ribs can be used to increase the resistance The ribs of the washer create contact points that minimize cymbal contact. This provides cleaner longer last tone. The ribs of the washer can be concave FIG. 3*a* leaving the outer points of the washer higher than the center. This further minimizes contact with the cymbal creating better sound. The washer can also be made with no concave feature FIG. 4*a*.

This washer can be made in various sizes to accommodate the various setups of a drum set. The standard size would have and outer annulus diameter of 1.5 inches and an inner diameter of 0.45 inches. The annulus would have a thickness of 0.1 inch with the center sleeve 1*b* extending 0.175 inches from either side. The ribs 1*c*, 1*e* would extend 0.25 inches from the annulus with a concave towards the center meeting the extent of the sleeve. An outer band of material 2*a* would connect the outer ends of the ribs not to exceed the height of the ribs.

Although the examples given include many specifications, they are intended as illustrative of only a few possible embodiments of the invention. Other embodiments and modifications will, no doubt, occur to those skilled in the art. Thus, the examples given should only be interpreted as illustrations of some of the preferred embodiments of the invention, and the full scope of the invention should not be limited to this description

What is claimed is:

1. A cymbal washer, comprising:

a resilient body having a top side and a bottom side, a center hole, and one or more touch areas for contacting the cymbal surrounding the center hole;

a first plurality of ribs extending from said top side of said resilient body, wherein said first plurality of ribs define a generally concave top surface of said cymbal washer; and a second plurality of ribs extending from said bottom side of said resilient body, wherein said second plurality of ribs define a generally concave bottom surface of said cymbal washer, wherein the touch areas are raised above surrounding areas of the resilient body.

2. The cymbal washer of claim 1, comprising one or more voids adjoining the touch areas, whereby muting of a sound produced by the cymbal is reduced.

3. The cymbal washer of claim 1, further comprising a further plurality of touch areas surrounding the center hole for contacting a flange support, the further touch areas occupying the bottom surface and also being raised above surrounding areas of the resilient body.

4. The cymbal washer of claim 3, wherein the touch areas and the further touch areas are in staggered alignment relative to one another.

5. The cymbal washer of claim 3, comprising one or more further voids adjoining the further touch areas, whereby muting of a sound produced by the cymbal is reduced.

6. The cymbal washer of claim 1, wherein the resilient body is formed of rubber.

7. A resilient washer structure, comprising:

an annulus having a top side and a bottom side;

a concentric sleeve extending from the annulus;

a first plurality of ribs extending from the sleeve on one side of the annulus and defining an upper surface of the resilient washer structure; and a second plurality of ribs extending from the sleeve on an opposite side of the annulus and defining a lower surface of the resilient washer structure, wherein the first plurality of ribs and the second plurality of ribs are in staggered alignment relative to one another.

8. The resilient washer structure of claim 7, wherein the sleeve extends above and below the annulus.

9. The resilient washer structure of claim 7, further comprising a rim adjoining terminal ends of at least one of the first plurality of ribs and the second plurality of ribs.

10. The resilient washer structure of claim 9, wherein the rim adjoins terminal ends of both the first plurality of ribs and the second plurality of ribs.

11. The resilient washer structure of claim 7, said upper surface comprising a concave surface.

12. A resilient washer structure, comprising:

an annulus having a top side and a bottom side;

a concentric sleeve extending from the annulus;

a first plurality of ribs extending from the sleeve on one side of the annulus and defining an upper surface of the resilient washer structure;

wherein the sleeve extends above and below the annulus; and a second plurality of ribs extending from the sleeve on an opposite side of the annulus and defining a lower surface of the resilient washer structure, wherein the lower surface is concave.

13. The resilient washer structure of claim 12, wherein the upper surface and the lower surface comprise concave surfaces.

14. The resilient washer structure of claim 12, the resilient body comprising a rubber or elastomer formation.

15. The resilient washer structure of claim 12, the resilient body comprising a rubber or elastomer formation.

* * * * *